US006556171B2

(12) United States Patent
Gillon et al.

(10) Patent No.: US 6,556,171 B2
(45) Date of Patent: Apr. 29, 2003

(54) EXTENDIBLE ANTENNA WITH ARTICULATING HINGE

(75) Inventors: Patrick J. Gillon, Plantation, FL (US); Chrome M. Cebe, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/777,766

(22) Filed: Feb. 6, 2001

(65) Prior Publication Data

US 2002/0105466 A1 Aug. 8, 2002

(51) Int. Cl.[7] ..... H01Q 1/24
(52) U.S. Cl. ..... 343/702; 343/901
(58) Field of Search ..... 343/702, 900, 343/901, 906; H01Q 1/24

(56) References Cited

U.S. PATENT DOCUMENTS 5,590,416 A * 12/1996 Rydbeck ..... 343/702
5,940,039 A * 8/1999 Wang et al. ..... 343/702
5,949,377 A * 9/1999 Matsumoto et al. ..... 343/702
6,034,639 A * 3/2000 Rawlins et al. ..... 343/702
6,104,350 A * 8/2000 Ng et al. ..... 343/702
6,163,301 A * 12/2000 Widfeldt ..... 343/702
6,301,489 B1 * 10/2001 Winstead et al. ..... 343/702
6,310,578 B1 * 10/2001 Ying ..... 343/702

* cited by examiner

*Primary Examiner*—Hoanganh Le
(74) *Attorney, Agent, or Firm*—Randi L. Dulaney

(57) ABSTRACT

An extendible antenna (10) includes an antenna rod (11) attached to a hinge (13) for rotational movement about a transverse axis (15) of the hinge (13). The hinge (13) is fitted within a housing (14) and is slidingly moveable therewithin. When the antenna rod (11) and the hinge (13) are in a fully extended position, the antenna rod (11) is pivotally rotatable relative to the housing (14) from a center position to either of two opposite end positions.

18 Claims, 3 Drawing Sheets

EXTENDIBLE ANTENNA WITH ARTICULATING HINGE

BACKGROUND OF THE INVENTION

1. Field of the Invention

This invention relates in general to the field of receiving and transmitting antennas and in particular to the field of extendible antennas which include a hinge to position the antenna for optimal reception.

2. Description of the Prior Art

Cellular phones, radios, and other like communication devices include an antenna to aid in receiving and transmitting a signal to permit clear voice communications. The antennas, in general, comprise either an integral antenna which is fixed and not extendible; or, an antenna which is extendible from its storage position within the communication device. In either design, the object is to achieve a communication device which is extremely compact in size. Compactness provides for storing or carrying convenience when the communication device is not being used and is, therefore, a highly desirable feature.

Ideally, an antenna should be positioned in alignment with the vertical regardless of the position of the communication device when held up to the head of a user. Obviously, a fixed, integral antenna provides no means for a user to adjust the position of the antenna relative to the vertical when being used. The reception of such an equipped device is, accordingly, only as good as that provided by the fixed design of the antenna. The user has no ability to attempt to improve the reception.

Prior art extendible antennas fall into two general categories. In one category, the antenna telescopes within the body of the device, but such that the alignment is fixed. The motion of the antenna is limited to up-and-down movement. In the other category, the antenna includes one or more telescoping segments attached to a rotatable base with a hinge connection to permit a user to angle the antenna in any direction. The base however, is otherwise stationary such that the antenna is always positioned outside the electronic device to which it is attached. This second category of extensible antennas suffers from reliability in that the electrical connection at the base deteriorates over time which effectively precludes this type of antenna from being used with modern day communication devices. A further disadvantage of this type of antenna is that the antenna is always exposed and, therefore, subject to damage.

To a limited extent, a user can somewhat improve the reception capabilities of a communication device having the first type of extendible antenna, above described. This is accomplished by the amount of distance the antenna is extended from its housing within the communication device. However, as noted above, this type of prior art extendible antennas only provide one alignment of the antenna relative to the communication device; that is, the longitudinal axis of the antenna is aligned with the longitudinal axis of the communication device whether extended or not. This type of prior art extendible antennas then, do not provide for the optimal reception angle of the antenna relative to the communication device when being held up against the head of a user.

What is needed is an extendible antenna which is stored within the communication device when not in use and is capable of being positioned at an optimal reception angle when the communication device is in use and up against the head of a user.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
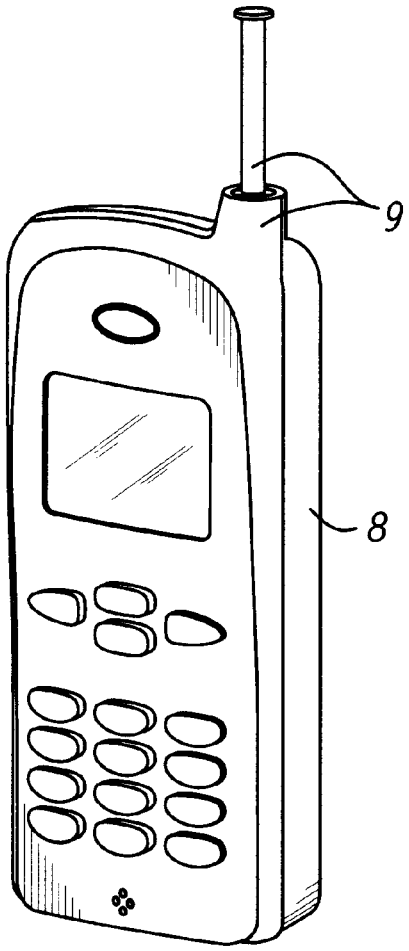
FIG. 1 illustrates a typical communication device having an extendible antenna which incorporates the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Reference is now made to the drawings, wherein like characteristics and features of the present invention shown in the various figures are designated by the same reference numerals.

FIG. 1 schematically illustrates a typical prior art cellular phone 8 such as made by Motorola, Inc., Schaumburg, Ill. The same is extremely small and compact. The tip of an extendible antenna 9 is seen to be positioned at the top right of the phone 8. While the present invention is adaptable to the illustrated phone 8, the invention is not limited to any particular phone, radio, or communication device. For example, the present invention is also adaptable to a phone which previously included a fixed, integral antenna.

Figure 2:
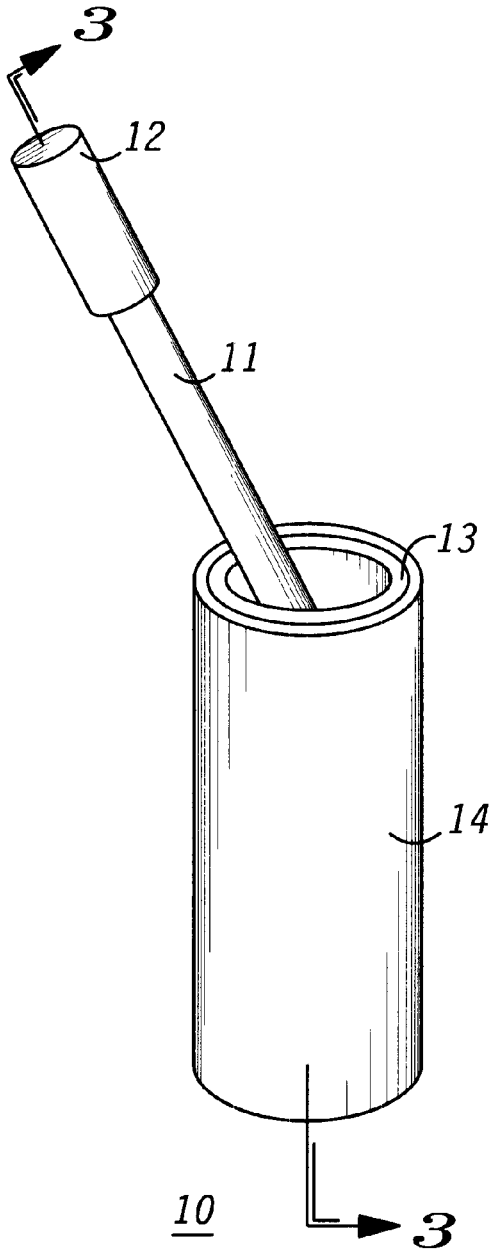
FIG. 2 is a perspective view of one embodiment of the antenna and its housing as provided for by the present invention.

FIG. 2 illustrates one embodiment of the present invention. In this embodiment, the antenna 10 includes a first extendible member 11, which for purposes of this description will be referred to as the "antenna rod 11." A second extendible member 12 comprises a cylindrical tube which is used to raise and lower the antenna rod 11, as well as provide extra length to the effective antenna 10 and can house electronic devices which enhance the effect of the antenna. Antenna rod 11 is pivotally attached to a hinge 13 which is slidingly fitted within the antenna housing 14, such that the antenna rod 11 and the hinge 13 move together in a single unit up and down within the housing 14. In FIG. 2, the antenna rod 11 is shown in one of its multiple positions relative to the housing 14.

Figure 3:
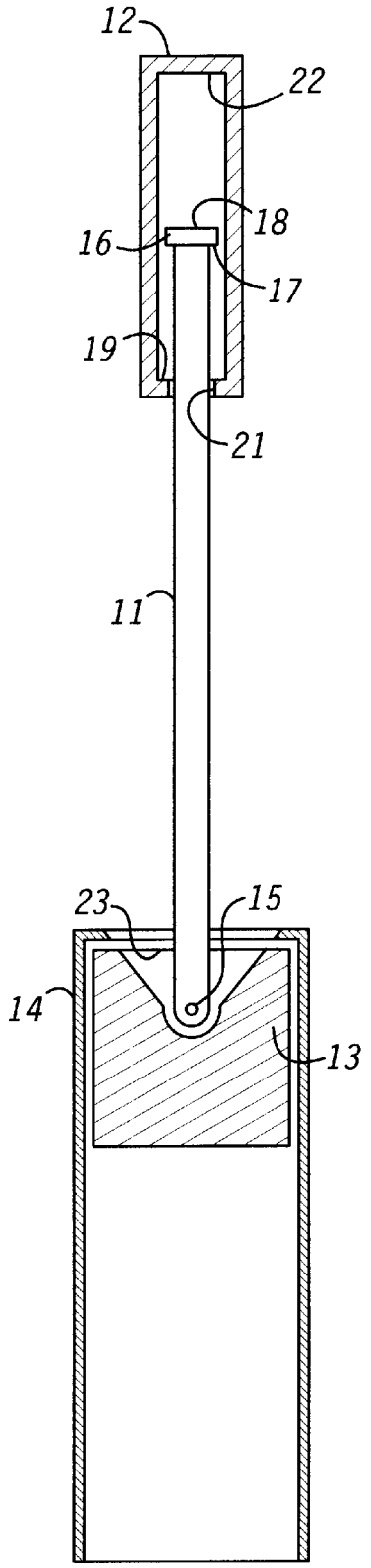
FIG. 3 is a cross-sectional view of the present invention taken along the line 3—3 of FIG. 2.

FIG. 3 shows the details of the construction of antenna 10. One end of the antenna rod 11 is pivotally attached to the hinge 13 by, for example, a pin 15. Antenna rod 11 can be solid or hollow as desired and consistent with normal design considerations such as strength, weight, etc. A flange member 16 is attached to the top or upper end of antenna rod 11, the purpose of which is to provide a shoulder 17 for raising the antenna rod 11 and a surface 18 to lower the antenna rod 11. The antenna raising and lowering member 12 (hereinafter "cylindrical member 12") comprises a hollow tube within which the flanged tip 16 of antenna rod 11 is slidingly fitted. The lower end of cylindrical member 12 includes a shoulder surface 19 and an opening 21. The combination of shoulders 17 and 19 when in contact with each other provides the means to raise the antenna rod 11 by pulling upon cylindrical member 12. The top end of cylindrical member 12 includes a surface 22 which when in contact with surface 18, provides for lowering of antenna rod 11 by pushing downward on cylindrical member 12.

In accordance with the above, it is seen that antenna rod 11 and cylindrical member 12 are telescopingly arranged and, therefore, provide an increased effective length of antenna 10 and, as noted above, can be used to contain antenna enhancing electronics. Of course, there must be some physical contact, and therefore an electrical connection between members 11 and 12 in order for the combination to act as a single antenna.

Still referring to FIG. 3, the housing 14 is seen to comprise another cylindrical member or hollow tube. When fully collapsed, antenna rod 11 and cylindrical member 12 fit within the housing 14. Not shown is the electrical connection of antenna 10 to the communication device 8. This connection can simply comprise any of the well-known methods of establishing an electrical connection. The hinge 13, to which antenna rod 11 is pivotally attached, is configured to slide up and down within housing 14 while maintaining an electrical connection therebetween. It is preferable but not necessary that the sliding arrangement of hinge 13 within housing 14 be such that there is no substantial rotation of hinge 13 about its axial centerline relative to housing 14. This may be accomplished by any number of known methods such as by mating axial splines on the outer diameter of hinge 13 and the internal diameter of housing 14, or by providing both the hinge 13 and the housing with a square cross-sectional configuration. It is immaterial to the invention how hinge 13 is prevented from rotating relative to housing 14.

As noted above, housing 14 is preferably sized such that cylindrical member 12 fits within the internal configuration of housing 14, such that a portion of cylindrical member 12 extends out of housing 14 for purposes of groping and pulling on cylindrical member 12. A shoulder or flange 23 is provided at the top portion of housing 14 to prevent disengagement of hinge 13 from the inside of housing 14 when the antenna rod 11 is extended.

Figure 4:
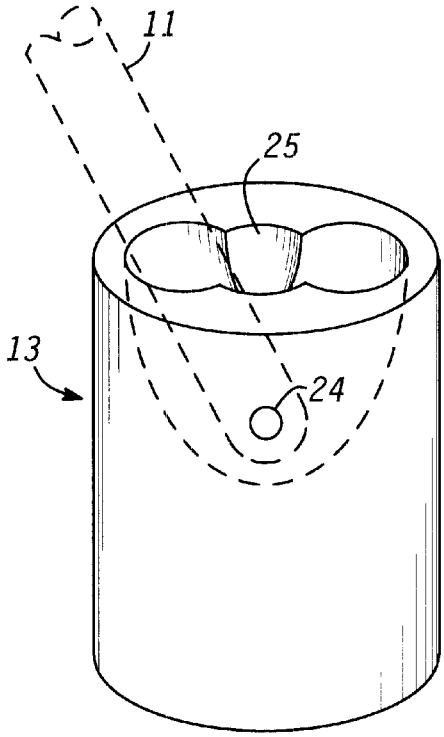
FIG. 4 is a perspective view of the hinge member of the embodiment of FIG. 3.

FIG. 4 illustrates one embodiment of the configuration of hinge 13 in accordance with the present invention. While hinge 13 is shown to have a cylindrical outer configuration, this showing is not to be interpreted as limiting the invention. As described in the examples provided above, a square configuration or a splined configuration or any other appropriate outer configuration can be used. A hole 24 is provided through the body of hinge 13 to allow for pivotable attachment of antenna rod 11 by a pin 15. Hinge 13 is provided with an internal configuration 25 which allows the antenna rod, when connected by pin 15, to pivot or partially rotate about the axial centerline of pin 15 and thereby change the angle between the axial centerline of antenna rod 11 relative to the axial centerline of housing 14. Accordingly, the internal configuration 25 provides the clearance space necessary to allow the antenna rod 11 to pivot from right to left and vice versa (see FIGS. 2 and 3). In this regard, the internal configuration 25 can assume a number of satisfactory shapes. For example, the internal configuration can have two opposite diverging sides with two other opposing sides being parallel, thereby forming a channel or slot to guide the motion of the antenna rod 11, as shown in FIG. 4. The internal configuration 25 can also comprise a circular opening rendering the hinge 13 to have a hollow cylindrical shape. It is to be understood that the pin arrangement only allows pivoting or rotation of the antenna rod 11 in one plane. Thus, a circular opening 25 would not adversely affect this motion and because of the restrictive motion provided by the pin 15 connection. Thus, the angle of antenna rod 11 can only be varied within its plane of motion.

The internal configuration 25 can further include discrete positional means, such as detents, for positively locating the antenna rod 11, in a desired number of predetermined positions, for example, straight up, to the left, and to the right. With this internal configuration, the user has the ability to orient the antenna rod 11 in a substantially vertical position regardless of whether the user holds the communication device 8 against his or her left or right ear. Since the line between a user's ear and mouth is approximately 45° to the vertical, the left, and the right stops of the internal configuration 25 can be set to allow positioning at 45 degrees. These settings thereby provide for a substantially vertical antenna rod 11 when the communication device is held up against a user's head, and which thereby results in enhanced reception and transmission. In order to obtain the full benefit of antenna 10, it is only necessary that the housing 14 be mounted within the communication device 8, with the housing 14 being in substantial alignment with the longitudinal axis of the communication device 8.

Figure 5:
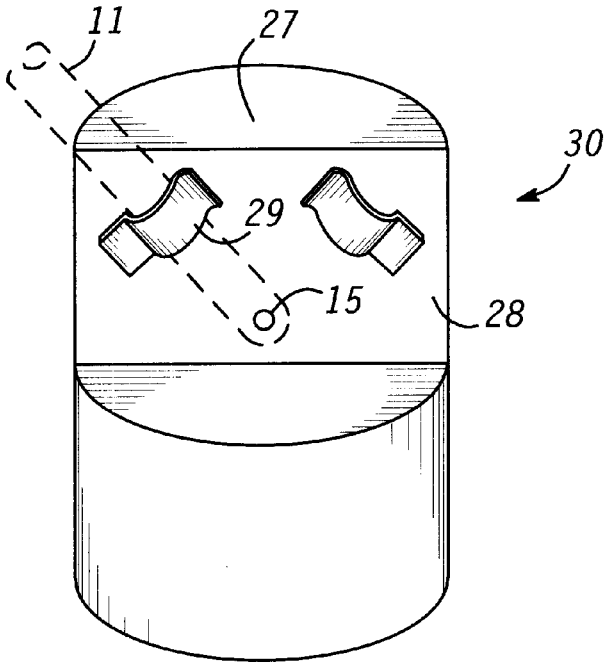
FIG. 5 illustrates another embodiment of the hinge member view of the present invention.

FIG. 5 illustrates yet another configuration of the hinge member which it may assume in practice and which for distinguishing purposes, will be referred to by numeral 30. Here, the hinge member 30 includes a cylindrical bottom portion 26 which provides for the guided, sliding motion within housing 14. The upper end of hinge member 13 is cut away, leaving a portion 27 having an essentially semicircular cross-sectional configuration and a flat vertical surface 28. The antenna rod 11 is again connected by a pin 15 to the hinge member 30, but here, the pin only traverses the upper portion 27 and such that the antenna rod 11 is fitted up against the flat surface 28 with the result that the antenna rod 11 is pivotably rotatable within a plane parallel to the flat surface 28. The side-to-side travel stops of antenna rod 11 can be provided by the internal diameter of flange 23 of housing 14, or by the clips 29 shown in FIG. 5. Clips 29 would also serve to frictionally hold the antenna rod 11 in either of its end positions, which places the antenna rod 11 at an angle to the centerline of the housing 14.

Figure 6:
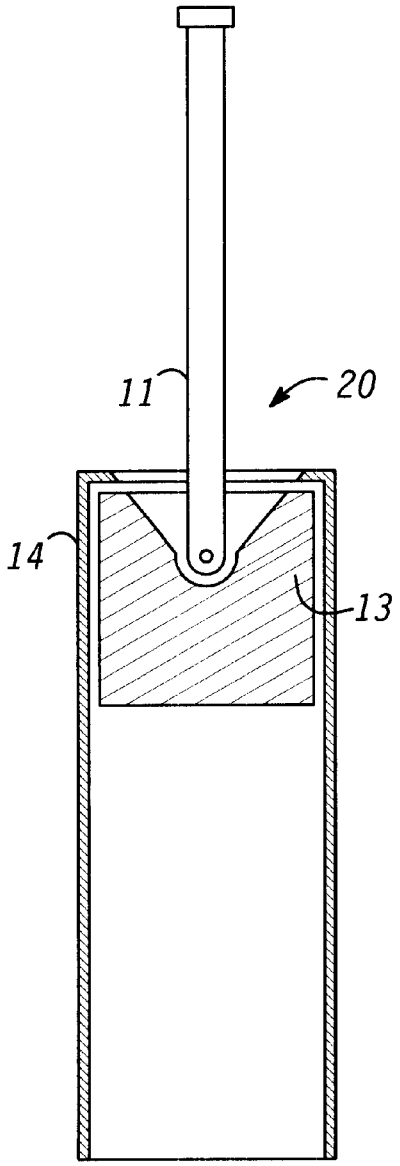
FIG. 6 depicts another embodiment of the present invention.

FIG. 6 illustrates another embodiment 30 of the present invention. In this embodiment 20, there is no raising or lowering cylindrical member 12. The antenna rod 11 and the hinge 13 are still extendible from within housing 14. The hinge 13 again provides for pivotal movement of the antenna rod 11 relative to housing 14. Thus, except for the absence of the cylindrical member 11, the embodiment 30 is in all respects similar to the embodiment 10.

In use, a person grasps either the exposed tip of the antenna rod 11 or the cylindrical member 12 and draws the antenna rod 11 outward from its storage location within the housing 14. During this movement, the hinge 13 slides upward along with the antenna rod 11 and stops at the shoulder or flange 23 at the top of the housing 14. The antenna rod 11 is then pivoted or partially rotated about the pin 15 to either of the end positions within hinge 13. When the user now puts the communication device 8 up to his ear and mouth, the antenna rod 11 is in a substantially vertical position. To retract the antenna rod 11 back into its storage location, the antenna rod 11 is rotated to its center position within hinge 13 and the antenna rod 11 is pushed down within the housing 14.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

What is claimed is:

1. An antenna apparatus comprising:

an extendible antenna rod;

a housing;

a hinge member coupled to a bottom end of said antenna rod, said antenna rod being attached to said hinge member and being pivotally rotatable relative to said hinge member, said hinge member being slidingly attached to said housing such that said antenna rod and said hinge member move together through multiple up and down positions within said housing, wherein said hinge member provides for said antenna rod to rotate relative to an axial centerline of said housing in the multiple up and down positions within said housing; and an extendible cylindrical member coupled to a top end of said antenna rod, wherein the top end and the bottom end are oppositely situated within said antenna rod, and further wherein the antenna rod is slidingly fitted to the cylindrical member for raising or lowering the antenna rod within the housing.

2. The apparatus of claim 1, wherein said hinge member has a configuration to allow said antenna rod to be pivotally rotated from a center position to either of opposite end positions.

3. The apparatus of claim 2, wherein said hinge member includes detents to frictionally maintain said antenna rod in either of said end positions.

4. The apparatus of claim 2, wherein said end positions are at an angle of approximately 45° to the center position.

5. The apparatus of claim 1, wherein said antenna rod is attached to said hinge member by a pin, a longitudinal axis of said pin being the rotational axis of said antenna rod.

6. The apparatus of claim 1, wherein said hinge member is substantially rotationally fixed relative to a longitudinal axis of said housing.

7. The apparatus of claim 1, including a communication device, said housing being attached to said communication device and in substantial alignment with a longitudinal axis of said communication device.

8. The apparatus of claim 1, including a stop surface on said housing to prevent dislodgment of said hinge member from within said housing when said antenna rod is fully extended.

9. The apparatus of claim 1, wherein said cylindrical member is telescopically connected to said antenna rod, said antenna rod and said cylindrical member being configured to fit within said housing when said antenna rod is not extended.

10. The apparatus of claim 9 further comprising an electrical connection between said antenna rod and said cylindrical member, wherein said cylindrical member further provides extra length to the antenna apparatus.

11. The apparatus of claim 1 wherein said cylindrical member further provides extra length to the antenna apparatus.

12. The apparatus of claim 1 wherein said antenna rod includes a flange member attached to said top end of said antenna rod, wherein said cylindrical member includes a shoulder surface and an opening, wherein said flange member contacts said shoulder surface for raising and lowering of the antenna rod through said opening.

13. A communication device for transmitting and receiving signals, comprising:

an antenna apparatus comprising:

a housing;

an extendible antenna rod;

a hinge member coupled to a bottom end of said antenna rod, said antenna rod being rotationally attached to said hinge member about a transverse axis of said hinge member, wherein said antenna rod and said hinge member are fitted within said housing and are slidingly movable relative to said housing such that said antenna rod and said hinge member move together through multiple up and down positions within said housing, wherein said hinge member provides for said antenna rod to rotate relative to an axial centerline of said housing in the multiple up and down positions within said housing; and an extendible cylindrical member coupled to a top end of said antenna rod, wherein the top end and the bottom end are oppositely situated within said antenna rod, and further wherein the antenna rod is slidingly fitted to the cylindrical member for raising or lowering the antenna rod within the housing.

14. The communication device of claim 13, wherein said antenna rod is positionable at a center position in alignment with a longitudinal axis of said housing and at an angle relative to said longitudinal axis of said housing.

15. The communication device of claim 14, wherein said antenna rod is pivotally rotatable about a single plane relative to said housing.

16. The communication device of claim 14, wherein said angle of said antenna rod relative to said housing is approximately 45° in either direction from the center position.

17. The communication device of claim 13 further comprising an electrical connection between said antenna rod and said cylindrical member, wherein said cylindrical member further provides extra length to the antenna apparatus.

18. The communication device of claim 13 wherein said cylindrical member houses a plurality of electronic devices for enhancing the effect of said antenna apparatus on the performance of said communication device.

* * * * *